US008493290B2

(12) United States Patent
Tsuchiya

(10) Patent No.: US 8,493,290 B2
(45) Date of Patent: Jul. 23, 2013

(54) INTEGRATED CIRCUIT DEVICE, ELECTRO OPTICAL DEVICE AND ELECTRONIC APPARATUS

(75) Inventor: Masahiko Tsuchiya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 638 days.

(21) Appl. No.: 12/714,758

(22) Filed: Mar. 1, 2010

(65) Prior Publication Data

US 2010/0225168 A1 Sep. 9, 2010

(30) Foreign Application Priority Data

Mar. 6, 2009 (JP) ..... 2009-052880

(51) Int. Cl.
*G09G 3/04* (2006.01)

(52) U.S. Cl.
USPC ..... 345/33; 345/204

(58) Field of Classification Search
USPC ..... 345/33–54, 204, 211–215; 307/29
See application file for complete search history.

(56) References Cited

U.S. PATENT DOCUMENTS 4,246,579 A * 1/1981 Wiesner ..... 345/49
4,380,371 A * 4/1983 Frantz ..... 349/142
6,204,831 B1 * 3/2001 Nishioka et al. ..... 345/53
7,362,293 B2 * 4/2008 Chang et al. ..... 345/87
2002/0180717 A1 * 12/2002 Ishiyama ..... 345/204
2005/0248550 A1 * 11/2005 Kobayashi et al. ..... 345/204
2006/0038801 A1 * 2/2006 Speirs ..... 345/204
2010/0066923 A1 * 3/2010 Imai et al. ..... 348/792
2010/0225168 A1 * 9/2010 Tsuchiya ..... 307/29

FOREIGN PATENT DOCUMENTS

JP A-02-236593 9/1990
JP A-6-222327 8/1994

* cited by examiner

*Primary Examiner* — Tom Sheng
(74) *Attorney, Agent, or Firm* — Oliff & Berridge, PLC

(57) ABSTRACT

An integrated circuit device includes: a segment driver having a plurality of segment signal output circuits for driving a plurality of segment lines; a common driver having a plurality of common signal output circuits for driving a plurality of common lines; and a power supply circuit that supplies a first power supply at a first voltage level, a second power supply at a second voltage level, a third power supply at a third voltage level and a fourth power supply at a fourth voltage level to the segment driver and the common driver, wherein each of the plurality of segment signal output circuits sets a voltage level of a segment signal to the third voltage level in a first transition period from a period in which the voltage level of the segment signal is set to the first voltage level to a period in which the voltage level of the segment signal is set to the fourth voltage level, and sets the voltage level of the segment signal to the second voltage level in a second transition period from a period in which the voltage level of the segment signal is set to the fourth voltage level to a period in which the voltage level of the segment signal is set to the first voltage level.

13 Claims, 13 Drawing Sheets

INTEGRATED CIRCUIT DEVICE, ELECTRO OPTICAL DEVICE AND ELECTRONIC APPARATUS

The entire disclosure of Japanese Patent Application No. 2009-52880, filed Mar. 6, 2009 is expressly incorporated by reference herein.

BACKGROUND

1. Technical Field

An aspect of the present invention relates to integrated circuit devices, electro optical devices and electronic apparatuses.

2. Related Art

Integrated circuit devices (drivers) with a built-in circuit for driving an electro optical panel such as an LCD (liquid crystal display) panel and the like are known. For example, in the case of a simple matrix type (passive type) electro optical panel equipped with common lines and segment lines, the integrated circuit device generates common signals and segment signals and supplies them to the electro optical panel. With this, characters such as numbers and alphabets are displayed on the electro optical panel. For example, JP-A-6-222327 describes a related art integrated circuit device.

The integrated circuit device described above needs to be provided with smoothing capacitors for the power supply lines to be used for driving electro optical elements such as liquid crystal elements, which would lead to a higher cost and a greater mounting area. Furthermore, if class-AB operational amplifiers are used as operational amplifiers (as impedance converter circuits) for supplying electrical powers, this would interfere with demands for lower power consumption and causes a problem of a larger sized integrated circuit device due to the area for the operational amplifiers.

SUMMARY

In accordance with some embodiments of the invention, it is possible to provide integrated circuit devices, electro optical devices and electronic apparatuses, which can reduce an adverse effect of which a change in the voltage level of one of a segment signal and a common signal may have on the other signal.

In accordance with an embodiment of the invention, an integrated circuit device includes: a segment driver having a plurality of segment signal output circuits for driving a plurality of segment lines; a common driver having a plurality of common signal output circuits for driving a plurality of common lines; and a power supply circuit that supplies a first power supply at a first voltage level, a second power supply at a second voltage level, a third power supply at a third voltage level and a fourth power supply at a fourth voltage level to the segment driver and the common driver, wherein each of the plurality of segment signal output circuits sets a voltage level of a segment signal to the third voltage level in a first transition period from a period in which the voltage level of the segment signal is set to the first voltage level to a period in which the voltage level of the segment signal is set to the fourth voltage level, and sets the voltage level of the segment signal to the second voltage level in a second transition period from a period in which the voltage level of the segment signal is set to the fourth voltage level to a period in which the voltage level of the segment signal is set to the first voltage level.

According to an aspect of the embodiment described above, in the first transition period in which the voltage level of the segment signal changes from the first voltage level to the fourth voltage level, the voltage level of the segment signal is set to the third voltage level. Also, in the second transition period in which the voltage level of the segment signal changes from the fourth voltage level to the first voltage level, the voltage level of the segment signal is set to the second voltage level. By so doing, adverse effects of which a change in the voltage level of one of the segment signal and the common signal may have on the other signal can be reduced.

In accordance with an aspect of the embodiment of the invention, each of the plurality of common signal output circuits may set a voltage level of a common signal to the second voltage level in the first transition period, and may set the voltage level of the common signal to the third voltage level in the second transition period.

With this, in the first transition period, the third voltage level and the second voltage level are set for the segment signal and the common signal, respectively. In the second transition period, the second voltage level and the third voltage level are set for the segment signal and the common signal, respectively. Therefore, in either of the transition periods, a voltage difference between the second and third voltage levels is applied to the electro optical elements.

In accordance with another embodiment of the invention, an integrated circuit device includes: a segment driver having a plurality of segment signal output circuits for driving a plurality of segment lines; a common driver having a plurality of common signal output circuits for driving a plurality of common lines; and a power supply circuit that supplies a first power supply at a first voltage level, a second power supply at a second voltage level, a third power supply at a third voltage level and a fourth power supply at a fourth voltage level to the segment driver and the common driver, wherein each of the plurality of segment signal output circuits sets a voltage level of a segment signal to the third voltage level in a first transition period from a period in which the voltage level of the segment signal is set to the first voltage level to a period in which the voltage level of the segment signal is set to the second voltage level, and sets the voltage level of the segment signal to the second voltage level in a second transition period from a period in which the voltage level of the segment signal is set to the fourth voltage level to a period in which the voltage level of the segment signal is set to the third voltage level.

According to an aspect of the embodiment described above, in the first transition period in which the voltage level of the segment signal changes from the first voltage level to the second voltage level, the voltage level of the segment signal is set to the third voltage level. Also, in the second transition period in which the voltage level of the segment signal changes from the fourth voltage level to the third voltage level, the voltage level of the segment signal is set to the second voltage level. By so doing, adverse effect of which a change in the voltage level of one of the segment signal and the common signal may have on the other signal can be reduced.

In accordance with an aspect of the other embodiment of the invention, each of the plurality of common signal output circuits may set a voltage level of a common signal to the second voltage level in the first transition period, and may set the voltage level of the common signal to the third voltage level in the second transition period.

By so doing, in the first transition period, the third voltage level and the second voltage level are set for the segment signal and the common signal, respectively. In the second transition period, the second voltage level and the third voltage level are set for the segment signal and the common signal, respectively. Therefore, in either of the transition periods, a voltage difference between the second and third voltage levels is applied to the electro optical elements.

In accordance with an aspect of the above-described embodiments, the length of the first transition period may be set to ½ or less of a period before or after the first transition period, and the length of the second transition period may be set to ½ or less of a period before or after the second transition period.

By making the transition period shorter in this manner, the effective driving period can be made longer. It is noted that the period before or after the first transition period means, for example, a period before or after (immediately before or immediately after) the first transition period, in which the voltage level of the segment signal is set to the first voltage level, the second voltage level or the fourth voltage level. Also, the period before or after the second transition period means, for example, a period before or after (immediately before or immediately after) the second transition period, in which the voltage level of the segment signal is set to the first voltage level, the third voltage level or the fourth voltage level.

In accordance with an aspect of the above-described embodiments, when the segment signal is set to the first voltage level in two consecutive periods, each of the plurality of common signal output circuits may set the voltage level of the segment signal at the third voltage level in a third transition period between a first half period and a second half period of the two consecutive periods; and when the segment signal is set to the fourth voltage level in two consecutive periods, each of the plurality of common signal output circuits may set the voltage level of the segment signal at the second voltage level in a fourth transition period between a first half period and a second half period of the two consecutive periods.

With this, the effective voltage to be applied to the electro optical elements can be made equal to those in other cases.

In accordance with an aspect of the embodiments described above, each of the common signal output circuits may set the voltage level of the common signal to the second voltage level in the third transition period, and may set the voltage level of the common signal to the third voltage level in the fourth transition period.

By so doing, the third voltage level and the second voltage level are set for the segment signal and the common signal in the third transition period, respectively, and the second voltage level and the third voltage level are set for the segment signal and the common signal in the fourth transition period, respectively. Accordingly, in either of the transition periods, a voltage difference between the second and third voltage levels is applied to the electro optical elements.

In accordance with an aspect of the above-described embodiments, the length of the third transition period may be set to ½ or less of a period before or after the third transition period, and the length of the fourth transition period may be set to ½ or less of a period before or after the fourth transition period.

By making the transition period shorter in this manner, the effective driving period can be made longer. It is noted that the period before or after the third transition period means, for example, a period (a first half period or a second half period) before or after (immediately before or immediately after) the third transition period, in which the voltage level of the segment signal is set to the first voltage level. Also, the period before or after the fourth transition period means, for example, a period (a first half period or a second half period) before or after (immediately before or immediately after) the fourth transition period, in which the voltage level of the segment signal is set to the fourth voltage level.

In accordance with another aspect of the embodiments described above, the power supply circuit may include a first impedance conversion circuit having a first differential section and a first output section for supplying the second power supply, a second impedance conversion circuit having a second differential section and a second output section for supplying the third power supply, wherein the first output section of the first impedance conversion circuit may include a first current source provided between a high potential side power supply node and a first output node and a first driver transistor provided between the first output node and a low potential side power supply node with a gate controlled by the first differential section, and the second output section of the second impedance conversion circuit may include a second driver transistor provided between the high potential side power supply node and a second output node with a gate controlled by the second differential section, and a second current source provided between the second output node and the low potential side power source node.

Accordingly, for example, as the current flowing through the first and second current sources of the first and second output sections can be made smaller, lower power consumption can be achieved.

In accordance with another aspect of the embodiments described above, when the first voltage level is V1, the second voltage level is V2, the third voltage level is V3 and the fourth voltage level is V4, a relation of $V1<V2<V3<V4$ may be established.

In accordance with another aspect of the embodiments described above, a relation of $V4-V3=V3-V2=V2-V1$ may be established.

In accordance with still another embodiment of the invention, an electro optical device includes any one of the integrated circuit devices described above.

In accordance with yet another embodiment of the invention, an electronic apparatus includes any one of the integrated circuit devices described above.

DESCRIPTION OF EXEMPLARY EMBODIMENTS

Preferred embodiments of the invention are described in detail below. It is noted that the embodiments described below should not unduly limit the content of the invention recited in the scope of the claimed invention, and all of the compositions to be described in the embodiments may not necessarily be indispensable as means for solution provided by the invention.

1. Composition

Figure 1:
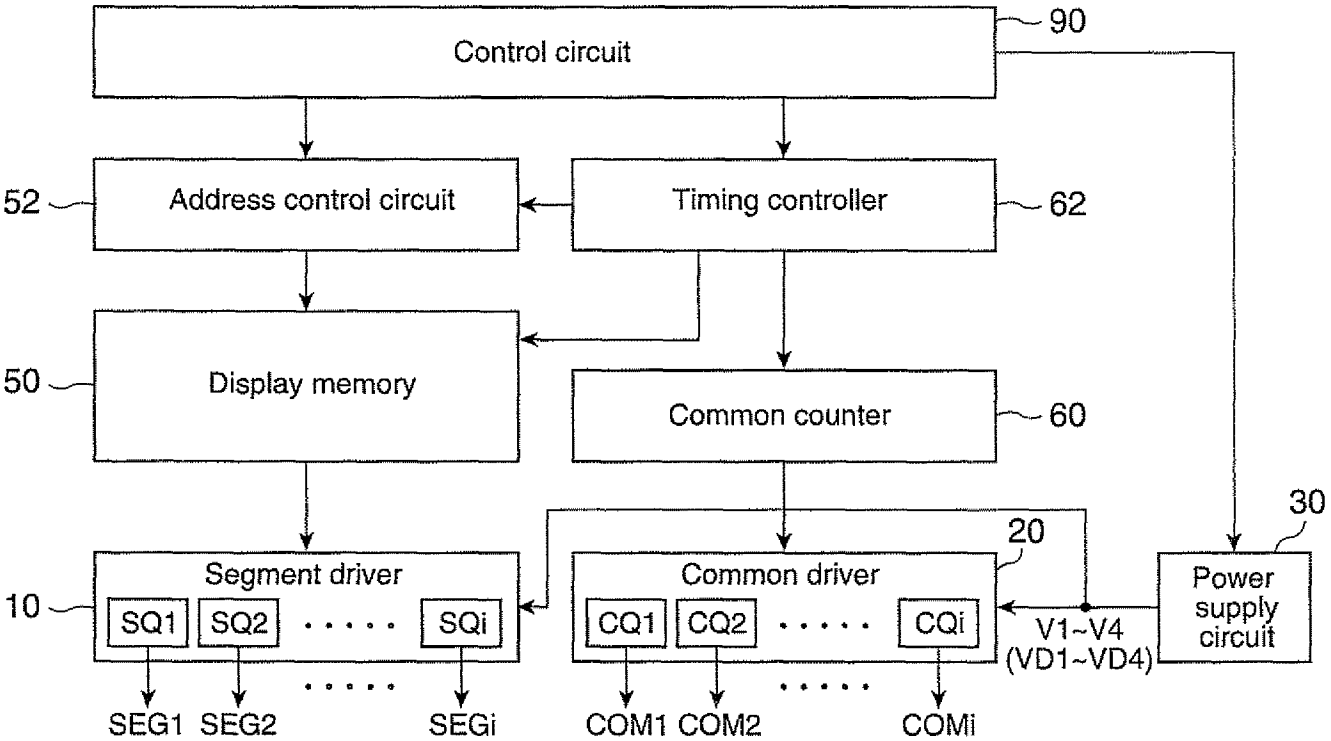
FIG. 1 shows a composition example of an integrated circuit device in accordance with an embodiment of the invention.

FIG. 1 shows a composition example of an integrated circuit device (a driver) in accordance with an embodiment of the invention. The integrated circuit device includes a segment driver 10, a common driver 20, and a power supply circuit 30. The integrated circuit device may also include a display memory 50, an address control circuit 52, a common counter 60, a timing controller 62 and a control circuit 90. It is noted that many modifications, such as, omission of a part of the components described above, addition of other components and the like can be made. For example, the integrated circuit device may be of a type that does not have a built-in display memory 50.

The segment driver 10 drives a plurality of segment lines (segment electrodes) of a liquid crystal panel (an electro optical panel in a broader sense). More specifically, the segment driver 10 includes a plurality of segment signal output circuits SQ1-SQi, and the segment signal output circuits SQ1-SQi supply segment signals (data signals) SEG1-SEGi to the segment lines (data lines) of the liquid crystal panel.

The common driver 20 drives a plurality of common lines (common electrodes) of the liquid crystal panel. More specifically, the common driver 20 includes a plurality of common signal output circuits CQ1-CQj, and the common signal output circuits CQ1-CQj supply common signals (scanning signals) COM1-COMj to common lines (scanning lines) of the liquid crystal panel.

The power supply circuit 30 generates a plurality of power supplies necessary for driving the liquid crystal panel (an electro optical device in a broad sense), and supplies the same to the segment driver 10 and the common driver 20. More specifically, for example, the power supply circuit 30 supplies first, second, third and fourth power supplies VD1, VD2, VD3 and VD4. Voltage levels of the first, second, third and fourth power supplies VD1, VD2, VD3 and VD4 will be presented below as V1, V2, V3 and V4, respectively. It is noted that the power supply circuit 30 may be set to provide five or more power supplies.

The display memory 50 (VRAM, an image memory) stores display data (image data), and stores display data per screen. Display data (segment data) read from the display memory 50 is supplied to the segment driver 10. The display memory may be composed of, for example, a RAM. Reading display data from the display memory 50 and writing display data to the display memory 50 are performed based on address signals from the address control circuit 52 and timing control signals from the timing controller 62.

The address control circuit 52 performs address control of the display memory 50. Specifically, the address control circuit 52 outputs address signals for reading display data from the display memory 50 and writing display data to the display memory 50. The address control circuit 52 operates based on various setting signals from the control circuit 90 and timing control signals from the timing controller 62.

The common counter 60 performs count processing for generating common signals based on the timing control signals from the timing controller 62. The common driver 20 outputs common signals based on count signals and the like from the common counter 60. The timing controller 62 generates and outputs various timing control signals in response to commands from the control circuit 90. The control circuit 90 controls the entire integrated circuit device, and performs controlling of circuit blocks of the integrated circuit device.

Figure 2:
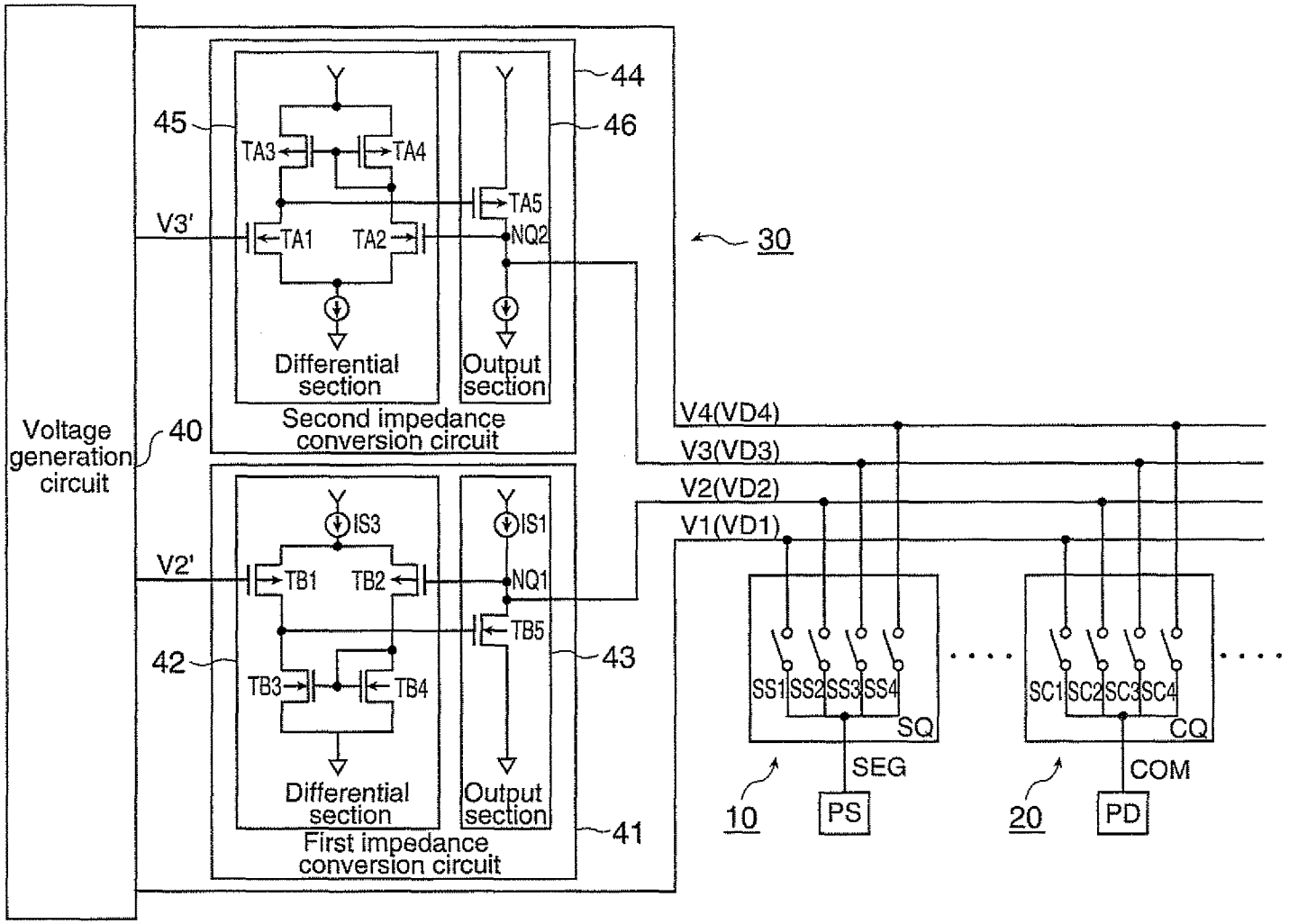
FIG. 2 shows a detailed composition example of a power supply circuit, a segment signal output circuit and a common signal output circuit.

FIG. 2 shows a detailed composition example of the segment driver 10, the common driver 20 and the power supply circuit 30. It is noted that the segment driver 10, the common driver 20 and the power supply circuit 30 are not limited to the composition shown in FIG. 2, and many modifications such as omission of a part of the components, addition of other components and the like can be made.

As shown in FIG. 2, each segment signal output circuit SQ (SQ1-SQi) of the segment driver 10 includes a plurality of switch elements SS1, SS2, SS3 and SS4. The switch elements SS1-SS4 may be made of, for example, transfer gates or the like.

Voltage levels V1, V2, V3 and V4 of the power supplies VD1, VD2, VD3 and VD4 are supplied to one ends of the switch elements SS1, SS2, SS3 and SS4, respectively, and the other ends of the switch elements SS1-SS4 are commonly connected to one another. More specifically, the other ends of the switch elements SS1-SS4 are connected to a pad PS (terminal) for the segment signal SEG. The switch elements SS1-SS4 are ON/OFF controlled based on unshown control signals (segment data). The segment signal output circuit SQ selects one of the voltage levels V1-V4 by the switch elements SS1-SS4, and outputs the selected voltage level as the segment signal SEG.

Each common signal output circuit CQ (CQ1-CQj) of the common driver 20 includes a plurality of switch elements SC1, SC2, SC3 and SC4. The switch elements SC1-SC4 may be made of, for example, transfer gates or the like.

Voltage levels V1, V2, V3 and V4 of the power supplies VD1, VD2, VD3 and VD4 are supplied to one ends of the switch elements SC1, SC2, SC3 and SC4, respectively, and the other ends of the switch elements SC1-SC4 are commonly connected to one another. More specifically, the other ends of the switch elements SC1-SC4 are connected to a pad PC (terminal) for the common signal COM. The switch elements SC1-SC4 are ON/OFF controlled based on unshown control signals. The common signal output circuit CQ selects one of the voltage levels V1-V4 by the switch elements SC1-SC4, and outputs the selected voltage level as the common signal COM.

The power supply circuit 30 includes a voltage generation circuit 40 and first and second impedance conversion circuits 41 and 42 (voltage output circuits).

The voltage generation circuit 40 may be made of a ladder resistance circuit. For example, when the VD4 and VD1 are a fixed high potential side power supply VDD and a low potential side power supply VSS, respectively, the voltage generation circuit 40 outputs voltage levels V3' and V2' that are obtained by voltage-dividing the VDD (VD4) and the VSS (VD1) with the ladder resistance circuit.

The first and second impedance conversion circuits 41 and 44 are so-called voltage-follower-connected operational amplifiers. The first impedance conversion circuit 41 receives the voltage level V2' from the voltage generation circuit 40, and outputs a voltage level V2 after impedance conversion. The second impedance conversion circuit 44 receives the voltage level V3' from the voltage generation circuit 40, and outputs a voltage level V3 after impedance conversion.

The first impedance conversion circuit 41 has a first differential section 42 and a first output section 43, and the second impedance conversion circuit 44 has a second differential section 45 and a second output section 46.

The output section 43 of the first impedance conversion circuit 41 includes a first current source IS1 and a first driver transistor TB5. The current source IS1 is provided between a node of the high potential side power supply VDD and a first output node NQ1. The current source IS1 may be realized by, for example, a P-type transistor with a gate to which a bias voltage is applied, or a P-type transistor with a drain and a gate mutually connected. The N-type driver transistor TB5 is provided between the output node NQ1 and a node of the low potential side power supply VSS, and has a gate controlled by the differential section 42.

The differential section 42 of the first impedance conversion circuit 41 is formed from a current source IS3 provided on the VDD side, P-type transistors TB1 and TB2 forming a differential pair, and N-type transistors TB3 and TB4 forming a current mirror circuit.

The output section 46 of the second impedance conversion circuit 44 includes a second driver transistor TA5 and a second current source IS2. The P-type driver transistor TA5 is provided between the VDD node and a second output node NQ2, and has a gate controlled by the differential section 45. The current source IS2 is provided between the output node NQ2 and the VSS node. The current source IS2 may be realized by, for example, an N-type transistor with a gate to which a bias voltage is applied, or an N-type transistor with a drain and a gate mutually connected.

The differential section 45 of the second impedance conversion circuit 44 is formed from a current source IS4 provided on the VSS side, N-type transistors TA1 and TA2 forming a differential pair, and P-type transistors TA3 and TA4 forming a current mirror circuit.

As shown in FIG. 2, by connecting the power supplies to the lines of V2 and V3 through the first and second impedance conversion circuits 41 and 44, respectively, low power consumption can be achieved. Specifically, the first impedance conversion circuit 41 that can draw much positive charge is connected to the V2 line in which the polarity of charge that needs to be transferred to the impedance conversion circuit side during a driving period becomes a positive polarity. Meanwhile, the second impedance conversion circuit 44 that can draw much negative charge is connected to the V3 line in which the polarity of charge that needs to be transferred to the impedance conversion circuit side during a driving period becomes a negative polarity. By so doing, the constant current flowing through the current sources IS1 and IS2 can be reduced, and the current flowing from the VDD to the VSS in the output sections 43 and 46 can be reduced, whereby low power consumption can be achieved.

2. Driving Method

Figure 3A:
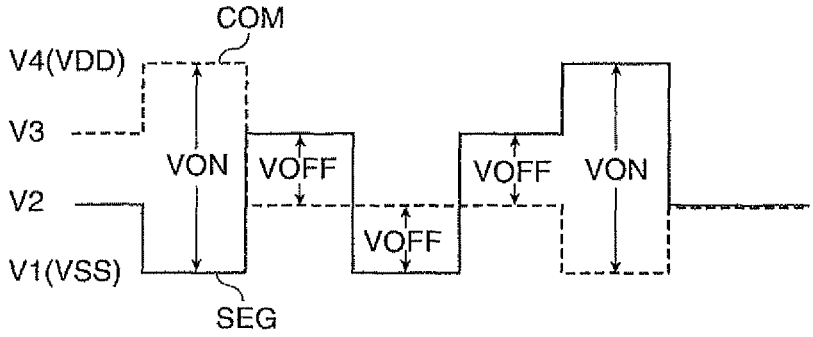
FIGS. 3A and 3B show charts for describing a method of driving an electro optical panel.

A driving method in accordance with an embodiment of the invention will be described next. As shown in FIG. 3A, in accordance with the present embodiment, the liquid crystal panel is driven by a voltage averaging method. For example, in FIG. 3A, four voltage levels, V1, V2, V3 and V4, are used as power supplies to drive the liquid crystal panel. V1 is for example a voltage level of a low potential side power supply VSS, and V4 is for example a voltage level of a high potential side power supply VDD.

For example, when the voltage level of the common signal COM is V4, and the voltage level of the segment signal SEG is V1, an ON voltage VON of V4−V1 is applied to liquid crystal elements (electro optical elements in a broad sense). On the other hand, when the voltage level of the common signal COM is V2 and the voltage level of the segment signal SEG is V3, an OFF voltage VOFF of V2−V3 is applied to liquid crystal elements.

Figure 3B:
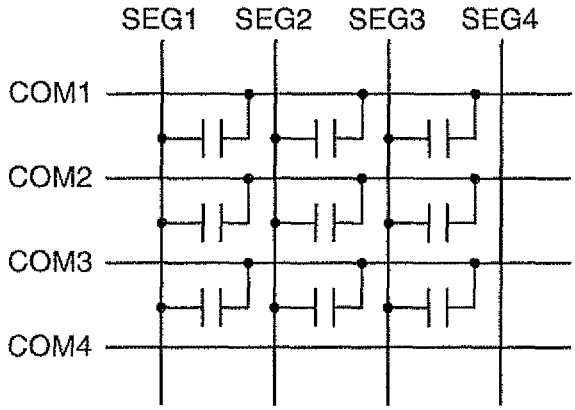

As shown in FIG. 3B, the liquid crystal elements are capacitive elements, such that capacitances of the liquid crystal elements are present between the segment lines and the common lines. Therefore, when the voltage level of one of the segment signal and the common signal changes, the change in the voltage level would affect the other signal.

Figure 4A:
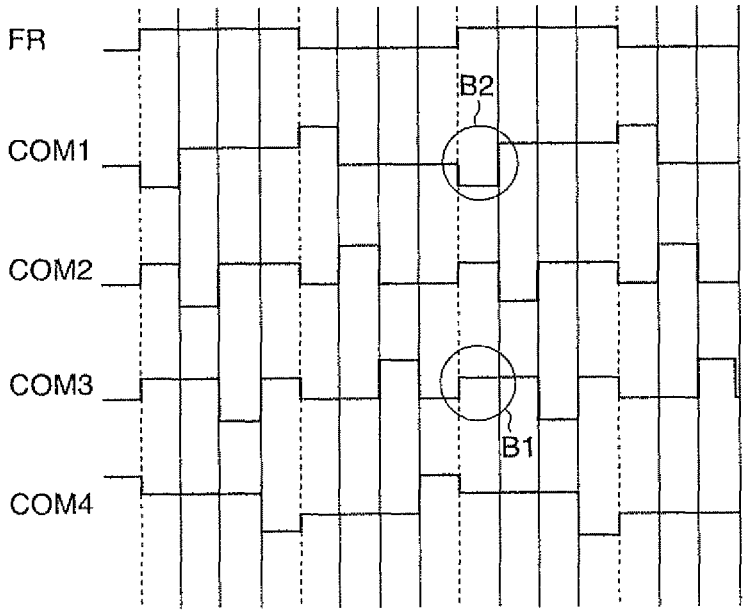
FIGS. 4A, 4B and 4C show exemplary waveforms in a driving method of a comparison example.
Figure 4B:
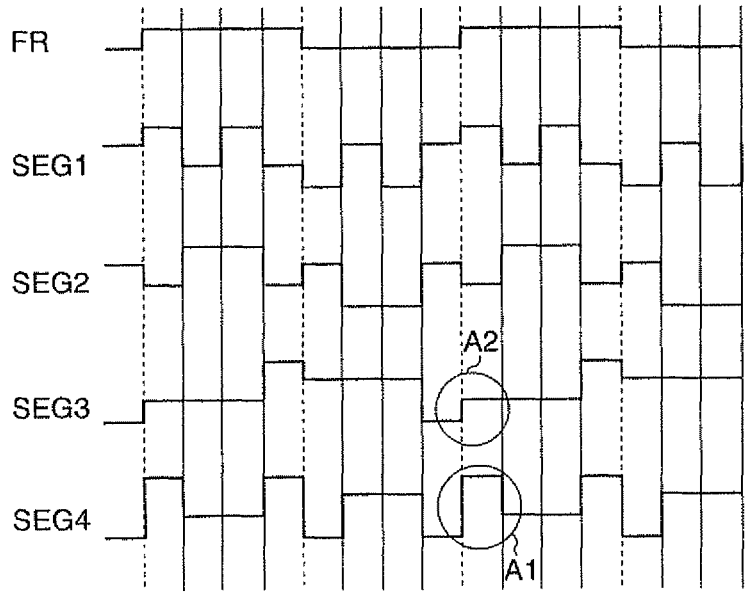
Figure 4C:
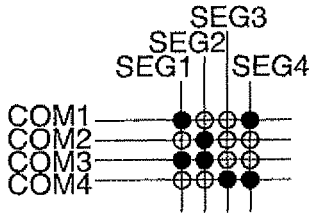

FIGS. 4A and 4B show exemplary waveforms in a driving method according to a comparison example. FIG. 4A shows exemplary waveforms of common signals. FIG. 4B shows exemplary waveforms of segment signals. FIGS. 4A and 4B show exemplary signal waveforms where the duty is ¼ and the bias is ⅓, whereby a display shown in FIG. 4C can be made by these signal waveforms. FIG. 40 shows an example of Normally White, where each pixel appears black when the effective voltage applied to the liquid crystal element is at an ON voltage level, and each pixel appears white when it is at an OFF voltage level.

Next, problems in the driving method of the comparison example shown in FIGS. 4A and 4B will be described with reference to FIGS. 5A through FIG. 6B.

Figure 5A:
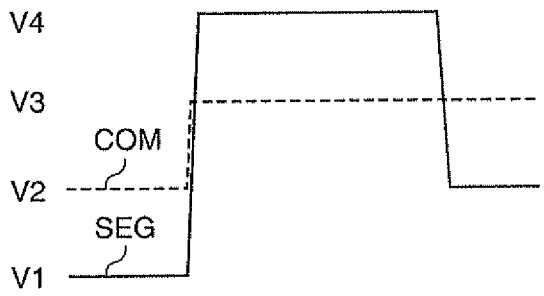
FIGS. 5A and 5B show charts for describing problems in the driving method of the comparison example.

FIG. 5A shows an enlarged view of a portion A1 in FIG. 4B. As shown in FIG. 5A, the voltage level of the segment signal SEG (SEG4) changes from the voltage level V1 of the first power supply VD1 to the voltage level V4 of the fourth power supply VD4. In this instance, let us assume that the voltage level of the common signal COM (COM3) changes from the voltage level V2 of the second power supply VD2 to the voltage level V3 of the third power supply VD3, as indicated at B1 of FIG. 4A. In this case, the state shown in FIG. 5A corresponds to signal waveforms at non-selection time at an intersection of COM3 and SEG4 shown in FIG. 4C.

When the voltage level of the segment signal SEG is changed from V1 to V4, as shown in FIG. 5A, the switch element SS1 of the segment signal output circuit SQ shown in FIG. 2 turns ON (SS2, SS3 and SS4 are OFF), and then the switch element SS4 turns ON (SS1, SS2 and SS3 are OFF). When the voltage level of the common signal COM is changed from V2 to V3, the switch element SC2 of the common signal output circuit CQ turns ON (SC1, SC3 and SC4 are OFF), and then the switch element SC3 turns ON (SC1, SC2 and SC4 are OFF).

Figure 5B:
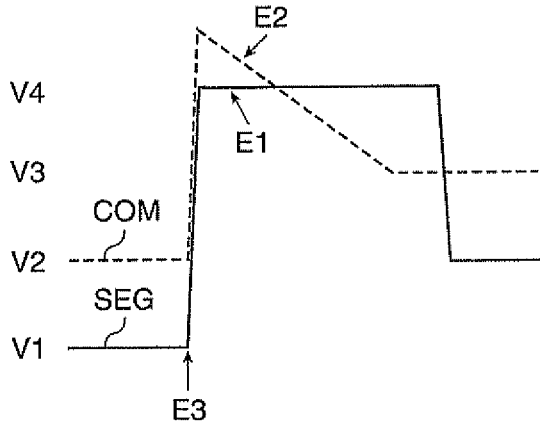

As the voltage levels V1 and V4 are supplied from the fixed power supply VDD and VSS (VD1 and VD4), respectively, the waveform of the segment signal SEG changes as indicated at E1 of FIG. 5B almost without any dullness. On the other hand, the common signal COM becomes to have a waveform indicated at E2.

More specifically, the segment signal SEG at the time of the voltage level switching indicated at E3 tries to push up the opposing common signal COM to a higher voltage level (potential) side by means of the capacitance of the liquid crystal element present between them (see FIG. 3B). Then, when the voltage level of the common signal COM rises, the voltage level V3 of the power supply VD3 also rises through the switch element SC3 in ON state in FIG. 2.

In this instance, the second impedance conversion circuit 44 tries to return the elevated voltage level V3 to a normal voltage level by means of the constant current flowing through the current source 182 of the output section 43.

However, if the constant current flowing through the current source IS2 is small, it takes a long time for the voltage level to return to the normal voltage level, and the common signal COM becomes to have a waveform indicated at E2 of FIG. 5B. In such a case, if the current flowing through the current source IS2 is made larger, the time to return to the normal voltage level can be shortened. However, the greater current flowing through the current source IS2 increases the current consumption.

When the common signal COM becomes to have the waveform indicated at E2 of FIG. 5B, the effective voltage to be applied to the liquid crystal elements also reduces, which deteriorates the display characteristic. For example, in FIG. 5B, the effective voltage of the OFF voltage level becomes smeller, whereby, for example, pixels that are supposed to be displayed as white would appear closer to a black display.

Figure 6A:
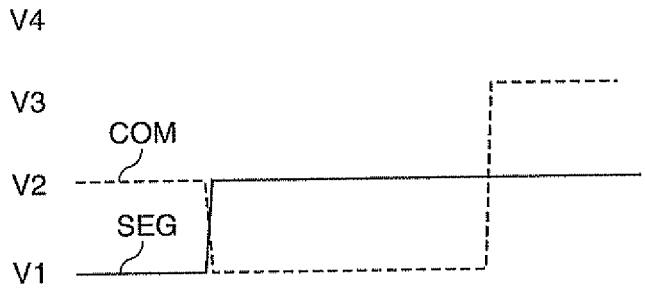
FIGS. 6A and 6B also show charts for describing problems in the driving method of the comparison example.

Meanwhile, FIG. 6A shows an enlarged view of a portion A2 in FIG. 4B. As shown in FIG. 6A, the voltage level of the segment signal SEG (SEG3) changes from V1 to V2. In this instance, let us assume that the voltage level of the common signal COM (COM1) changes from V2 to V1, as indicated at B2 of FIG. 4A. In this case, the state shown in FIG. 6A corresponds to signal waveforms at non-selection time at an intersection of COM1 and SEG3 in FIG. 4C.

When the voltage level of the segment signal SEG is changed from V1 to V2, as shown in FIG. 6A, the switch element SS1 of the segment signal output circuit SQ shown in FIG. 2 turns ON (SS2, SS3 and SS4 are OFF), and then the switch element SS2 turns ON (SS1, SS3 and SS4 are OFF). When the voltage level of the common signal COM is changed from V2 to V1, the switch element SC2 of the common signal output circuit CQ turns ON (SC1, SC3 and SC4 are OFF), and then the switch element SC1 turn ON (SC2, SC3 and SC4 are OFF).

Figure 6B:
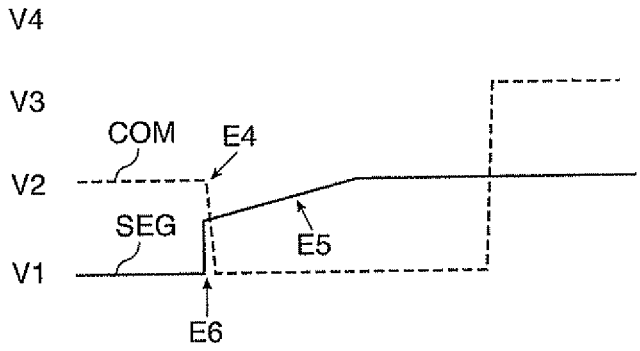

The waveform of the common signal COM changes as indicated at E4 of FIG. 6B almost without any dullness. On the other hand, the segment signal SEG becomes to have a waveform indicated at E5.

More specifically, the common signal COM at the time of the voltage level switching indicated at E6 tries to push down the opposing segment signal SEG to a lower voltage level side by means of the capacitance of the liquid crystal element present between them. Then, when the voltage level of the segment signal SEG drops, the voltage level V2 of the power supply VD2 also drops through the switch element SS2 in ON state in FIG. 2.

In this instance, the first impedance conversion circuit 41 connected to the V2 line tries to return the dropped voltage level V2 to a normal voltage level by means of the constant current flowing through the current source IS1 of the output section 43. However, if the constant current flowing through the current source IS1 is small, it takes a long time for the voltage level to return to the normal voltage level, and the segment signal SEG becomes to have a waveform indicated at E5 of FIG. 6B. In such a case, if the current flowing through the current source IS2 is made larger, the time to return to the normal voltage level can be shortened. However, the greater current flowing through the current source IS1 increases the power consumption.

When the segment signal SEG becomes to have the waveform indicated at E5 of FIG. 6B, the effective voltage to be applied to the liquid crystal elements also reduces, which deteriorates the display characteristic. For example, in FIG. 6B, the effective voltage of the OFF voltage level becomes smaller, whereby, for example, pixels that are supposed to be displayed as white would appear closer to a black display.

As a method for solving the problems described above with reference to FIG. 5A-FIG. 6B, it is possible to use a method to provide smoothing capacitors for the V2 line and the V3 line. However, such a method entails problems leading to a greater number of components in the electronic apparatus and higher costs, and also resulting in a greater mounting area. Furthermore, for example, if class AB operational amplifiers are used as the first and second impedance conversion circuits, the power consumption also increases.

Figure 7A:
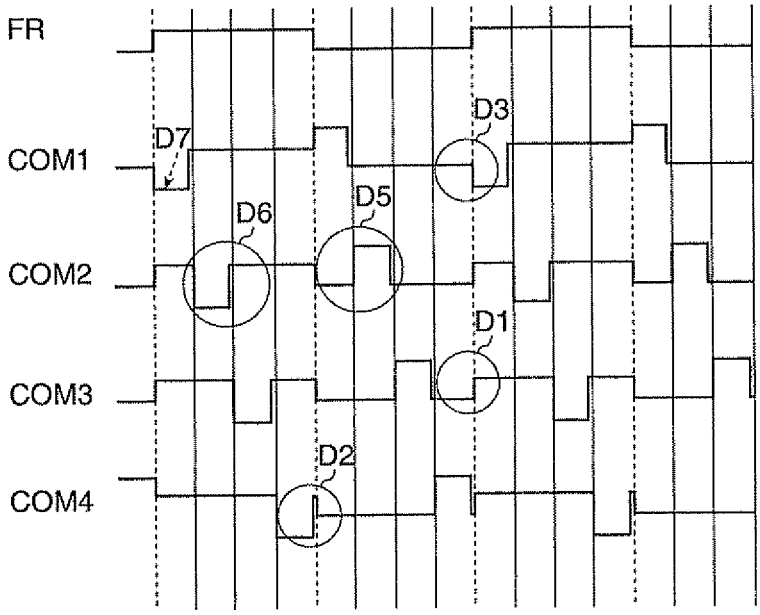
FIGS. 7A and 7B show exemplary waveforms in a driving method in accordance with an embodiment of the invention.
Figure 7B:
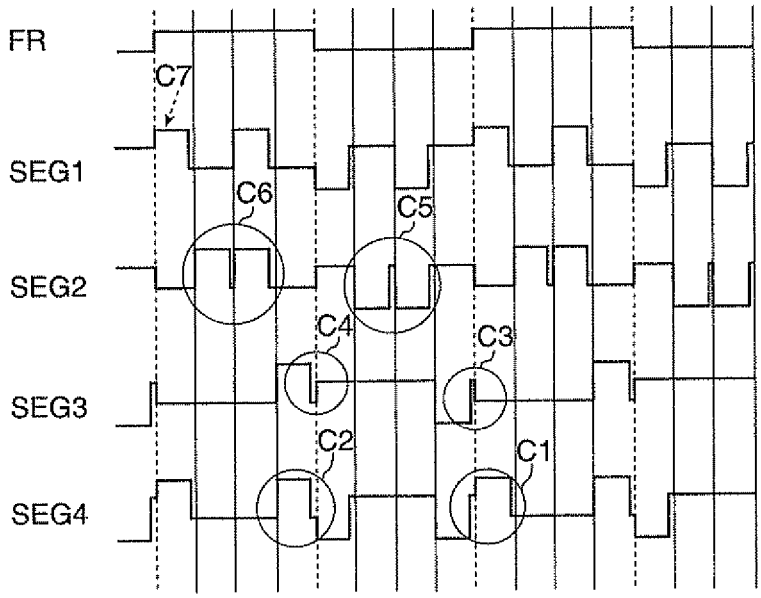

Examples of waveforms of a driving method in accordance with an embodiment of the invention to address the aforementioned problems are shown in FIGS. 7A and 7B. FIGS. 7A and 7B show exemplary signal waveforms, like those shown in FIGS. 4A and 4B, where the duty is ¼ and the bias is ⅓, whereby a display shown in FIG. 4C can be made by these signal waveforms. In the present embodiment, the voltage levels of the segment signal and the common signal are set in a manner that OFF voltage levels are applied to the liquid crystal elements in a transition period in which the voltage level is switched.

Figure 8A:
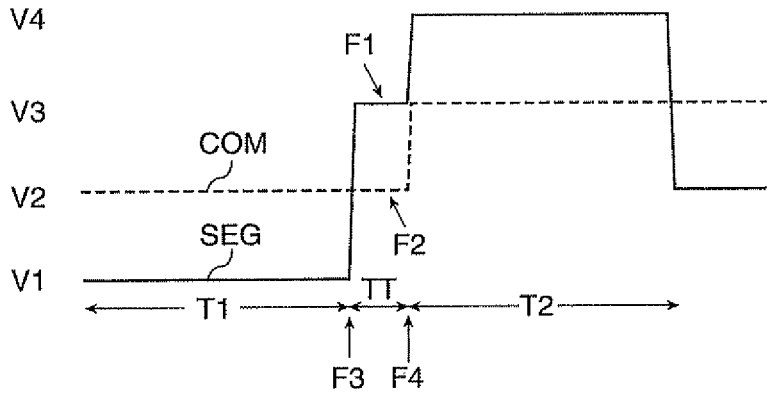
FIGS. 8A and 8B show charts for describing the driving method in accordance with the embodiment of the invention.

FIG. 8A shows an enlarged view of a portion C1 in FIG. 7B. This figure shows a case in which the voltage level of the common signal COM changes in a manner indicated at D1 in FIG. 7A.

As is clear from the comparison between FIG. 8A and FIG. 5A, in accordance with the present embodiment, the voltage level of the segment signal SEG is set at the third voltage level V3 during a first transition period TT from a period T1 in which the voltage level of the segment signal SEG is set at the first voltage level V1 to a period T2 in which the voltage level of the segment signal SEG is set at the fourth voltage level V4.

Specifically, in FIG. 8A, the segment signal output circuit SQ sets the voltage level of the segment signal SEG at V1 in the period T1 (the first period). Then, the segment signal output circuit SQ sets the voltage level of the segment signal SET at V3 as indicated at F1 in the transition period TT (the first transition period) following the period T1, and to V4 in the period T2 (the second period) following the transition period TT. In other words, the voltage level is changed from V1 to V3 and V3 to V4.

Meanwhile, the common signal output circuit CQ sets the voltage level of the common signal COM at V2 as indicated at F2. By so doing, as indicated at F1 and F2, the OFF voltage level is always applied to liquid crystal elements during the transition period TT without depending on whether the voltage level is the ON voltage level or the OFF voltage level during the periods before and after the transition period, whereby the problems described above with reference to FIG. 5B can be solved.

More specifically, as indicated at F1 in FIG. 8A, when the voltage level of the segment signal SEG changes from V1 to V3, the voltage level of the common signal COM is maintained at V2 as indicated at F2. Further, as shown in FIG. 2, the V2 line is connected to the N-type driver transistor TIM of the output section 43 of the first impedance conversion circuit 41.

Accordingly, even when the segment signal SEG, at the time of the voltage level switching indicated at F3, acts to push up the opposing common signal COM to a higher voltage level by means of the capacitance of the liquid crystal element present between them, such a situation can be countered. Specifically, as the N-type driver transistor connected to the V2 line flows sufficient current (charge) to the VSS side, the voltage level of the common signal COM would hardly rise.

Also, in the transition period TT, the voltage level of the segment signal SEG is set at V3 as indicated at F1. Further, as shown in FIG. 2, the V3 line is connected to the P-type driver transistor TA5 of the output section 46 of the second impedance conversion circuit 44. Accordingly, as the P-type driver transistor TA5 connected to the V3 line supplies sufficient current (charge) from the VDD side, the voltage level of V3 can also be maintained.

Then, as the voltage level of the segment signal SEG changes from V3 to V4 at the timing of F4 indicated in FIG. 8A, the voltage level of the common signal COM is raised by means of the capacitance of the liquid crystal element from V2 to V3.

Specifically, during the period T1, the voltage level V2 of the common signal COM is higher than the voltage level V1 of the segment signal SEG; and during the transition period TT, the voltage level V3 of the segment signal SEG is higher than the voltage level V2 of the common signal COM. Accordingly, at the time of changing from the period T1 to the transition period TT, the application voltage to the capacitor of the liquid crystal element changes from, for example, a positive voltage to a negative voltage, such that the first and second impedance conversion circuits 41 and 44 are required to have a high current supplying capability.

In this respect, in the example shown in FIG. 8A, the P-type driver transistor TA5 of the second impedance conversion circuit 44 connected to the V3 line pulls up the segment signal SEG from V1 to V3 with its high current supply capability, as described above. Even when the segment signal SEG rises from V1 to V3, and acts to push up the voltage level of the common signal COM by means of the capacitance of the liquid crystal element, the N-type driver transistor TB5 of the first impedance conversion circuit 41 is connected to the V2 line. Accordingly, the voltage level of the common signal COM can be prevented from being pushed up.

On the other hand, when the transition period TT changes to the period T2, the polarity of the applied voltage to the capacitance of the liquid crystal element does not change. For this reason, the segment signal SEG and the common signal COM change to V4 and V3, respectively, while maintaining a voltage difference of V3-V2, unlike the case of changing from the period T1 to the transition period TT where the polarity of the applied voltage to the capacitance of the liquid crystal element changes from a positive polarity to a negative polarity.

Figure 8B:
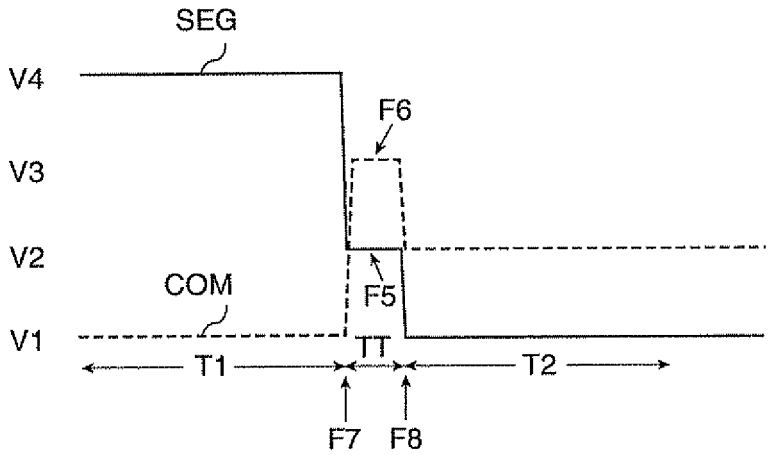

FIG. 8B shows an enlarged view of a portion C2 in FIG. 7B. This figure shows a case in which the voltage level of the common signal COM changes in a manner indicated at D2 in FIG. 7A. In FIG. 8B, the voltage level of the segment signal SEG is set to the second voltage level V2 in a second transition period TT between a period T1 in which the voltage level of the segment signal SEG is set to the fourth voltage level V4 and a period T2 in which the voltage level of the segment signal SEG is set to the first voltage level V1.

Specifically, in FIG. 8B, the segment signal output circuit SQ sets the voltage level of the segment signal SEG at V4 in the period T1 (third period). Then, the segment signal output circuit SQ sets the voltage level of the segment signal SEG at V2 in the transition period TT (second transition period), and to V1 in the period T2 (fourth period). In other words, the voltage level is changed from V4 to V2, and V2 to V1.

Meanwhile, the common signal output circuit CQ sets the voltage level of the common signal COM at V3 in the transition period TT, as indicated at F6.

By so doing, as indicated at F5 and F6, the OFF voltage level is applied to liquid crystal elements during the transition period TT. Further, the P-type transistor TA5 that can draw potential to the VDD side by its high driving capability is connected to the V3 line. This can accordingly prevent an incident where a change in the voltage level of the segment signal SEG pulls up the voltage level of the common signal COM.

Figure 9A:
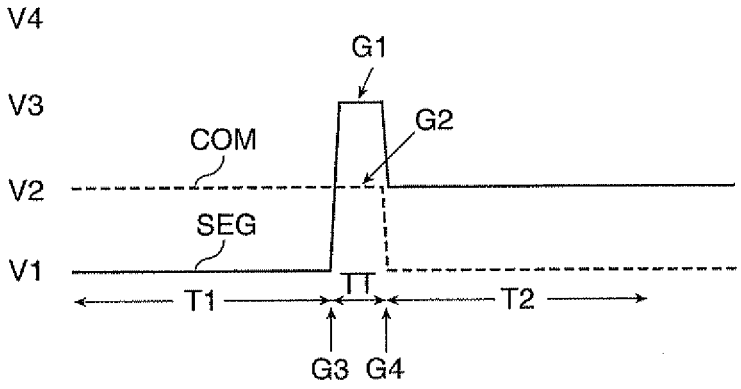
FIGS. 9A and 9B also show charts for describing the driving method in accordance with the embodiment of the invention.

FIG. 9A shows an enlarged view of a portion C3 in FIG. 7B. This figure shows a case in which the voltage level of the common signal COM changes in a manner indicated at D3 in FIG. 7A. In FIG. 9A, the voltage level of the segment signal SEG is set to the third voltage level V3 in a first transition period TT between a period T1 in which the voltage level of the segment signal SEG is set to the first voltage level V1 and a period T2 in which the voltage level of the segment signal SEG is set to the second voltage level V2.

Specifically, in FIG. 9A, the segment signal output circuit SQ sets the voltage level of the segment signal SEG at V1 in the period T1 (first period). Then, the segment signal output circuit SQ sets the voltage level of the segment signal SEG at V3 in the transition period TT (first transition period), as indicated at G1, and to V2 in the period T2 (second period). In other words, the voltage level is changed from V1 to V3, and from V3 to V2.

Meanwhile, the common signal output circuit CQ maintains the voltage level of the common signal COM at V2 in the transition period TT, as indicated at G2. In this manner, as indicated at G1 and G2, the OFF voltage level can be applied to the liquid crystal element during the transition period TT, whereby the problems described with reference to FIG. 6B can be solved.

Specifically, as indicated at G1 in FIG. 9A, when the voltage level of the segment signal SEG changes from V1 to V3, the voltage level of the common signal COM is set at V2, as indicated at G2. This accordingly prevents an incident where the voltage level of the segment signal SEG is pushed up to the VSS side as indicated at E5 in FIG. 6B. Further, as the N-type transistor TB5 of the first impedance conversion circuit 41 is connected to the V2 line, the voltage level of the common signal COM can be maintained at V2, even when the segment signal SEG changes from V1 to V3.

Then, when the voltage level of the segment signal SEG changes from V3 to V2 at the timing of G4, the voltage level of the common signal COM is also raised by means of the capacitance of the liquid crystal element, and changes from V2 to V1.

Figure 9B:
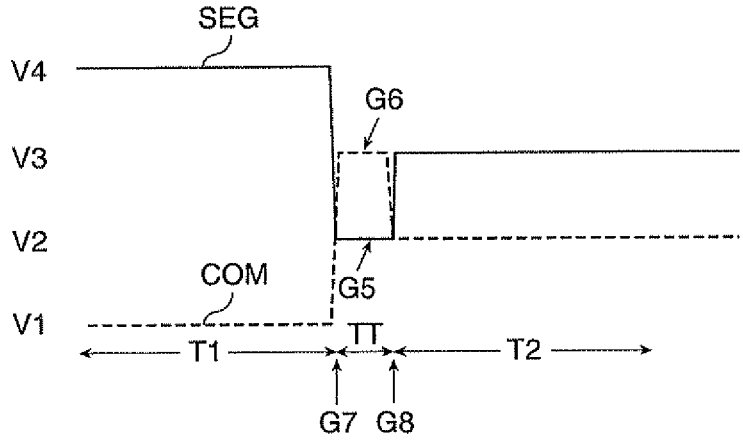

FIG. 9B shows an enlarged view of a portion C4 in FIG. 7B. This figure shows a case in which the voltage level of the common signal COM changes in a manner indicated at D2 in FIG. 7A. In FIG. 9B, the voltage level of the segment signal SEG is set to the second voltage level V2 in a second transition period TT between a period T1 in which the voltage level of the segment signal SEG is set to the fourth voltage level V4 and a period T2 in which the voltage level of the segment signal SEG is set to the third voltage level V3.

Specifically, in FIG. 9B, the segment signal output circuit SQ sets the voltage level of the segment signal SEG at V4 in the period T1 (third period). Then, the segment signal output circuit SQ sets the voltage level of the segment signal SEG at V2 in the transition period TT (second transition period), as indicated at G5, and to V3 in the period T2 (fourth period). In other words, the voltage level is changed from V4 to V2, and from V2 to V3.

Meanwhile, the common signal output circuit CQ sets the voltage level of the segment signal COM at V3 in the transition period TT, as indicated at G6.

By so doing, as indicated at G5 and G6, the OFF voltage level is applied to liquid crystal elements during the transition period TT. This can accordingly prevent an incident where a change in the voltage level of the common signal COM pulls up the voltage level of the segment signal SEG.

Figure 10A:
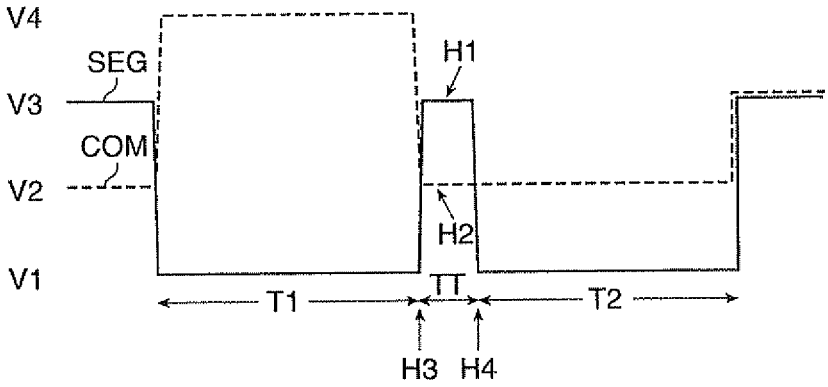
FIGS. 10A and 10B also show charts for describing the driving method in accordance with the embodiment of the invention.

FIG. 10A shows an enlarged view of a portion C5 in FIG. 7B. This figure shows a case in which the voltage level of the common signal COM changes in a manner indicated at D5 in FIG. 7A. In FIG. 10A, the segment signal SEG is set to the first voltage level V1 in two consecutive periods. Further, the voltage level of the segment signal SEG is set to the third voltage level V3 in a third transition period TT between a first half period T1 and a second half period T2 of the two periods.

Specifically, in FIG. 10A, the segment signal output circuit SQ sets the voltage level of the segment signal SEG at V1 in the period T1 (fifth period). Then, the segment signal output circuit SQ sets the voltage level of the segment signal SEG at V3 in the transition period TT (third transition period), as indicated at H1, and to V1 in the period T2 (sixth period). In other words, the voltage level is changed from V1 to V3, and from V3 to V1.

Meanwhile, the common signal output circuit CQ sets the voltage level of the common signal COM at V2 in the transition period TT, as indicated at H2.

By so doing, as indicated at H1 and H2, the OFF voltage level is applied to liquid crystal elements during the transition period TT. Further, the effective application voltage to the liquid crystal elements can be made equal to those of the waveform examples described with reference to FIG. 8A-FIG. 9B.

Figure 10B:
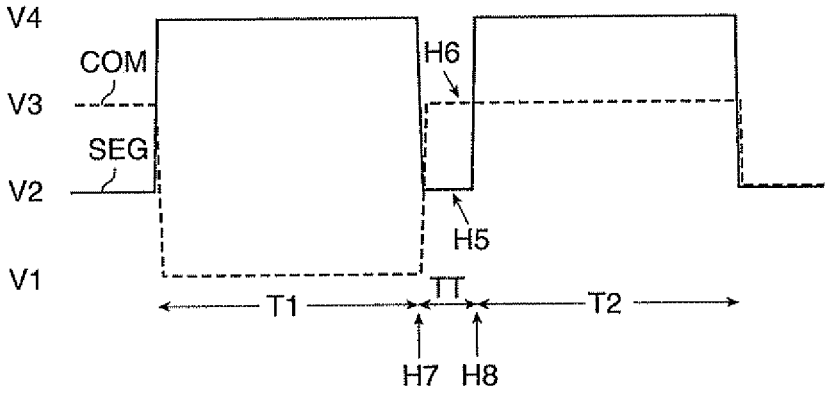

FIG. 10B shows an enlarged view of a portion C6 in FIG. 7B. This figure shows a case in which the voltage level of the common signal COM changes in a manner indicated at D6 in FIG. 7A. In FIG. 10B, the segment signal SEG is set to the fourth voltage level V4 in two consecutive periods. Further, the voltage level of the segment signal SEG is set to the second voltage level V2 in a fourth transition period TT between a first half period T1 and a second half period T2 of the two periods.

Specifically, in FIG. 10B, the segment signal output circuit SQ sets the voltage level of the segment signal SEG at V4 in the period T1 (seventh period). Then, the segment signal output circuit SQ sets the voltage level of the segment signal SEG at V2 in the transition period TT (fourth transition period), as indicated at H5, and to V4 in the period T2 (eighth period). In other words, the voltage level is changed from V4 to V2 and from V2 to V4.

Meanwhile, the common signal output circuit CQ sets the voltage level of the common signal COM at V3 in the transition period TT, as indicated at H6.

By so doing, as indicated at H5 and H6, the OFF voltage level is applied to liquid crystal elements during the transition period TT. Further, the effective application voltage to the liquid crystal elements can be made equal to those of the waveform examples described with reference to FIG. 8A-FIG. 9B.

According to the methods in accordance with the embodiments described above, it is possible to reduce the adverse effect of which a change in the voltage level of one of the segment signal and the common signal may have on the other signal. Accordingly, the problems described with reference to FIG. 5B and FIG. 6B can be solved, and deterioration of the display quality can be prevented.

As a method for solving the problems described with reference to FIG. 5B and FIG. 6B, it is possible to use a method that uses smoothing capacitors provided in the V2 and V3 lines or the like. However, such a method requires external capacitors, which leads to a higher cost. In this respect, according to the method of the present embodiment, such capacitors are not necessary, and thus lower cost and size-reduction of apparatuses can be achieved.

As another method for solving the problems described with reference to FIG. 5B and FIG. 6B, it is possible to use a method that uses large currents flowing in the current sources of the output sections of the first and second impedance conversion circuits. The use of such a method makes it difficult to realize lower power consumption. In this respect, according to the method of the present embodiment, currents flowing through the current sources of the output sections of the first and second impedance conversion circuits do not have to be made large, such that lower power consumption can be readily realized. Further, the power supply circuit can be simplified and reduced in size.

In FIGS. 8A-10B, the length of the transition period TT may be set, for example, to ½ or less of the length of either the period T1 or T2 before and after the transition period TT. Preferably, the length of the transition period TT may be set to ¼ or less of the length of either the period T1 or T2. More preferably, the length of the transition period TT may be set to ⅛ or less, 1/16 or less, or 1/32 or less of the length of either the period T1 or T2. By so doing, the effective driving period can be made longer by the length of the transition period TT shortened.

In accordance with an embodiment of the invention, when the first voltage level is V1, the second voltage level is V2, the third voltage level is V3 and the fourth voltage level is V4, for example, the relation of V1<V2<V3<V4 may be established. Also, for example, the relation of V4−V3=V3−V2=V2−V1 may be established. In other words, the voltage levels have an equal potential difference. However, modified embodiments that do not have such relations are also possible. Further, the present embodiment is described above as to cases where the embodiment is applied to a four-level driving method that uses the first-fourth voltage levels. However, the invention is not limited to such an embodiment, and is also applicable to, for example, a six-level driving method and the like.

3. Modified Example of Driving Method

Figure 11A:
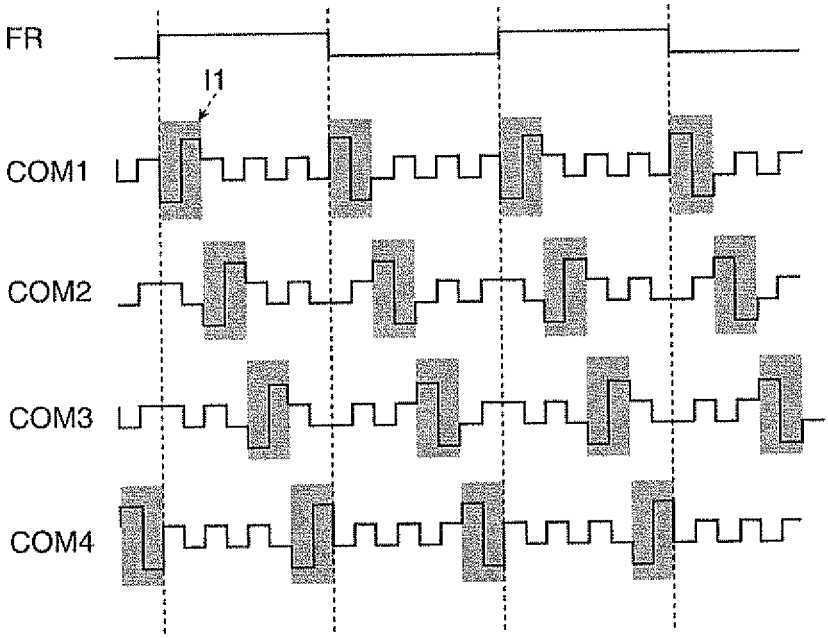
FIGS. 11A and 11B show other exemplary waveforms in the driving method of the comparison example.
Figure 11B:
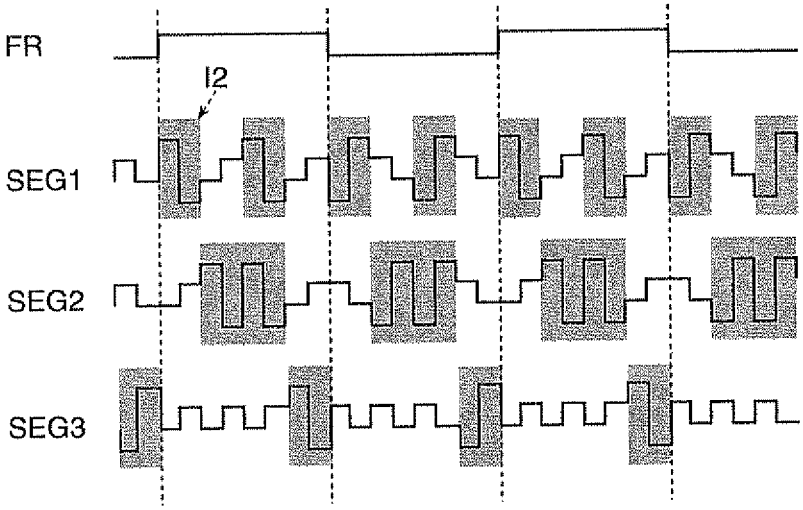

FIGS. 11A and 11B show examples of waveforms in a driving method in accordance with a comparison example. According to the driving method of the comparison example, for example, as indicated at I1 and I2, polarity inversion of the application voltage to liquid crystal elements is performed in each selected period. More specifically, in FIGS. 7A and 7B, the polarity of the application voltage to liquid crystal elements is not inverted in each of the selected periods. However, in FIGS. 11A and 11B, the polarity of the application voltage to liquid crystal elements is inverted in each selected period.

Figure 12A:
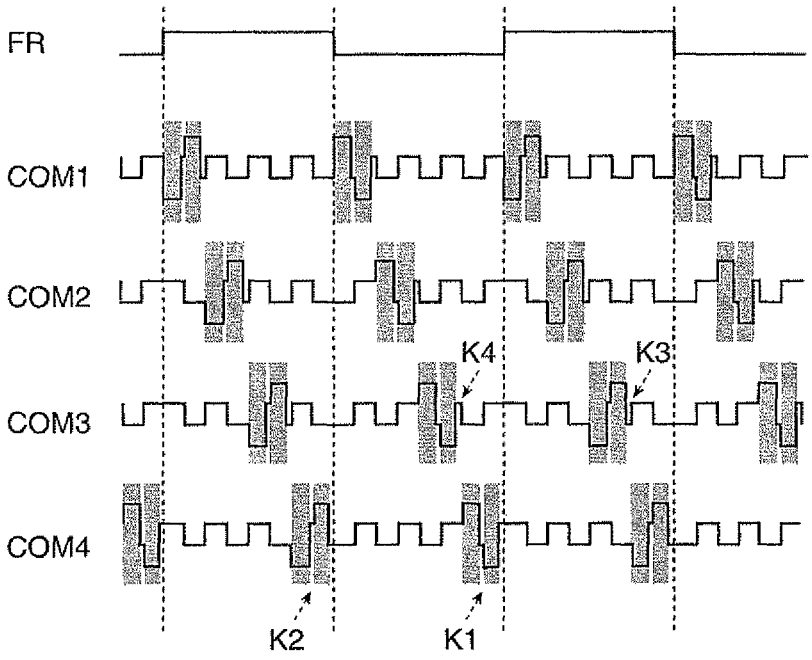
FIGS. 12A and 12B show other exemplary waveforms in the driving method in accordance with the embodiment of the invention.
Figure 12B:
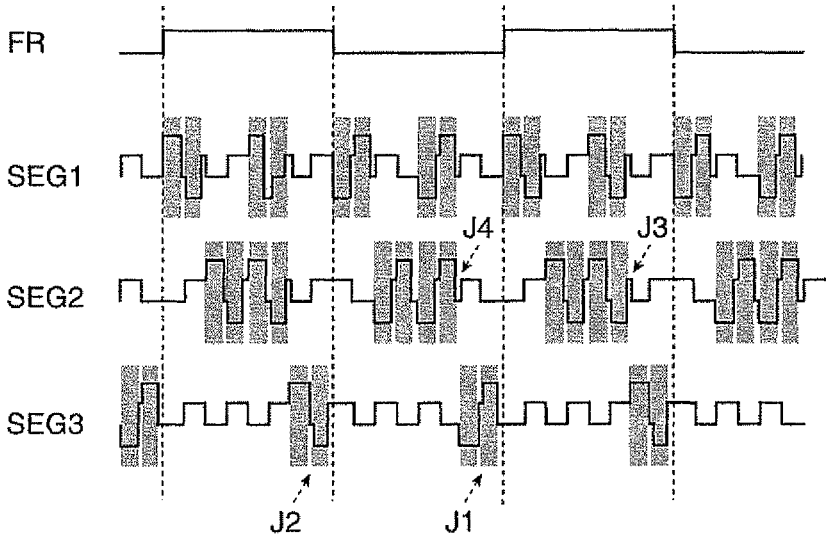

FIGS. 12A and 12B show examples of waveforms to be formed when the method in accordance with the present embodiment is applied to the driving method shown in FIGS. 11A and 11B. In FIGS. 12A and 12B, an OFF voltage level is applied to liquid crystal elements in each transition period.

Specifically, for example, at J1 in FIG. 12B, the voltage level of the segment signal SEG is changed from V1 to V3 and from V3 to V4, like the example shown in FIG. 8A. In a transition period when the voltage level of the segment signal SEG becomes to be V3, the voltage level of the common signal COM is set to V2, for example, as indicated at K1 in FIG. 12A.

Also, at J1 in FIG. 12B, the voltage level of the segment signal SEG is changed from V4 to V2 and from V2 to V1, like the example shown in FIG. 8B. In a transition period when the voltage level of the segment signal SEG becomes to be V2, the voltage level of the common signal COM is set to V3, for example, as indicated at K2 in FIG. 12A.

Also, at J3 in FIG. 12B, the voltage level of the segment signal SEG is changed from V1 to V3 and from V3 to V2, like the example shown in FIG. 9A. In a transition period when the voltage level of the segment signal SEG becomes to be V3, the voltage level of the common signal COM is set to V2, for example, as indicated at K3 in FIG. 12A.

Also, at J4 in FIG. 12B, the voltage level of the segment signal SEG is changed from V4 to V2 and from V2 to V3, like the example shown in FIG. 9B. In a transition period when the voltage level of the segment signal SEG becomes to be V2, the voltage level of the common signal COM is set to V3, for example, as indicated at K4 in FIG. 12A.

Accordingly, likewise the examples shown in FIGS. 7A-10B, it is possible to prevent incidents in which the voltage level of the segment signal SEG or the common signal COM is pushed up or pushed down by means of the capacitance of the liquid crystal element. This can effectively prevent an incident of deterioration of the display quality due to changes in the effective voltages such as the OFF voltage level and the like.

It is noted that the driving method in accordance with the present embodiment is not limited to those shown in FIGS. 7A and 7B and FIGS. 12A and 12B, and a variety of other driving methods equivalent to those described above can also be used.

4. Electronic Apparatus

Figure 13:
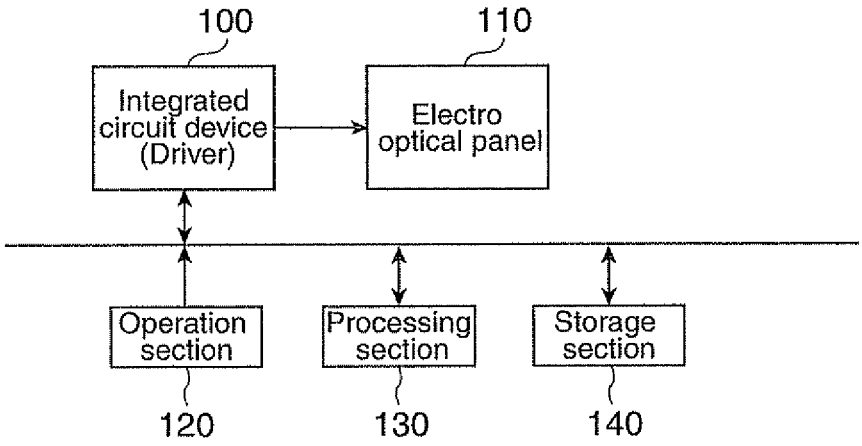
FIG. 13 shows a composition example of an electronic apparatus and an electro optical device.

FIG. 13 shows a composition example of an electronic apparatus that includes an integrated circuit device 100 in accordance with the present embodiment. The electronic apparatus includes the integrated circuit device 100, an electro optical panel 110, an operation section 120, a processing section 130, and a storage section 140. It is noted that many modifications, such as, omission of a portion of the components, addition of other components and the like can be made. Furthermore, an electro optical device in accordance with an embodiment of the invention may be realized with, for example, the electro optical panel 110 and the integrated circuit device 100.

The integrated circuit device 100 is a driver for driving the electro optical panel 110. The integrated circuit device 100 may have a function other than that of the driver, and may be a microcomputer with a built-in driver.

The electro optical panel 110 displays various images, and may be realized with, for example, a liquid crystal panel or the like. The electro optical panel 110 may be an electrophoretic display (EPD) panel or the like, without being particularly limited to a liquid crystal panel.

The operation section 120 allows the user to input a variety of information, and may be realized with a variety of buttons, a keyboard and the like. The processing section 130 performs a variety of control processings and operation processings necessary for the operations of the electronic apparatus. The processing section 130 may be realized with, for example, a processor such as a CPU. The storage section 140 stores a variety of data, and may be realized with a RAM, a ROM and the like.

As the electronic apparatuses realized by the present embodiment, a variety of apparatuses, such as, on-vehicle devices, cellular phones, electronic paper, clocks, remote controllers, LCD TVs, car navigation devices, calculators, portable information terminals, a variety of home appliances and the like can be enumerated.

It is noted that, although some embodiments of the invention have been described in detail above, those skilled in the art would readily appreciate that many modifications are possible without departing in substance from the novel matter and effects of the invention. Accordingly, such modifications are deemed to be included within the scope of the invention. For example, throughout the specification and the drawings, any terms described at least once with other different terms that encompass broader meaning or are synonymous can be replaced with these different terms in any sections of the specification and the drawings. Also, all combinations of the present embodiments and their modified examples are also included within the scope of the invention. Furthermore, many changes can be made to the integrated circuit device, the electro optical device, the composition and operations of the electronic apparatus, and the driving method, without being limited to the embodiments described herein.

What is claimed is:

1. An integrated circuit device comprising:

a segment driver having a plurality of segment signal output circuits for driving a plurality of segment lines;

a common driver having a plurality of common signal output circuits for driving a plurality of common lines; and a power supply circuit that supplies a first power supply at a first voltage level, a second power supply at a second voltage level, a third power supply at a third voltage level and a fourth power supply at a fourth voltage level to the segment driver and the common driver, a segment signal output circuit of the plurality of segment signal output circuits setting a voltage level of a segment signal to the third voltage level in a first transition period from a period in which the voltage level of the segment signal is set to the first voltage level to a period in which the voltage level of the segment signal is set to the fourth voltage level, and setting the voltage level of the segment signal to the second voltage level in a second transition period from a period in which the voltage level of the segment signal is set to the fourth voltage level to a period in which the voltage level of the segment signal is set to the first voltage level, and a common signal output circuit of the plurality of common signal output circuits setting a voltage level of a common signal to the second voltage level in the first transition period, and setting the voltage level of the common signal to the third voltage level in the second transition period.

2. An integrated circuit device according to claim 1, wherein the length of the first transition period is set to ½ or less of a period before or after the first transition period, and the length of the second transition period is set to ½ or less of a period before or after the second transition period.

3. An integrated circuit device according to claim 1, wherein, when the segment signal is set to the first voltage level in two consecutive periods, each of the plurality of segment signal output circuits sets the voltage level of the segment signal at the third voltage level in a third transition period between a first half period and a second half period of the two consecutive periods; and when the segment signal is set to the fourth voltage level in two consecutive periods, each of the plurality of segment signal output circuits sets the voltage level of the segment signal at the second voltage level in a fourth transition period between a first half period and a second half period of the two consecutive periods.

4. An integrated circuit device according to claim 3, wherein each of the common signal output circuits sets the voltage level of the common signal to the second voltage level in the third transition period, and sets the voltage level of the common signal to the third voltage level in the fourth transition period.

5. An internal circuit device according to claim 3, wherein the length of the third transition period is set to ½ or less of a period before or after the third transition period, and the length of the fourth transition period is set to ½ or less of a period before or after the fourth transition period.

6. An internal circuit device according to claim 1, wherein the power supply circuit includes:

a first impedance conversion circuit having a first differential section and a first output section for supplying the second power supply, a second impedance conversion circuit having a second differential section and a second output section for supplying the third power supply, wherein the first output section of the first impedance conversion circuit includes a first current source provided between a high potential side power supply node and a first output node and a first driver transistor provided between the first output node and a low potential side power supply node with a gate controlled by the first differential section, and the second output section of the second impedance conversion circuit includes a second driver transistor provided between the high potential side power supply node and a second output node with a gate controlled by the second differential section, and a second current source provided between the second output node and the low potential side power source node.

7. An integrated circuit device according to claim 1, wherein the first voltage level is V1, the second voltage level is V2, the third voltage level is V3 and the fourth voltage level is V4, a relation of V1<V2<V3<V4 is established.

8. An integrated circuit device according to claim 7, wherein a relation of V4−V3=V3−V2=V2−V1 is established.

9. An electro optical device comprising the integrated circuit device recited in claim 1.

10. An electronic apparatus comprising the integrated circuit device recited in claim 1.

11. An integrated circuit device comprising:

a segment driver having a plurality of segment signal output circuits for driving a plurality of segment lines;

a common driver having a plurality of common signal output circuits for driving a plurality of common lines; and a power supply circuit that supplies a first power supply at a first voltage level, a second power supply at a second voltage level, a third power supply at a third voltage level and a fourth power supply at a fourth voltage level to the segment driver and the common driver, a segment signal output circuit of the plurality of segment signal output circuits setting a voltage level of a segment signal to the third voltage level in a first transition period from a period in which the voltage level of the segment signal is set to the first voltage level to a period in which the voltage level of the segment signal is set to the second voltage level, and setting the voltage level of the segment signal to the second voltage level in a second transition period from a period in which the voltage level of the segment signal is set to the fourth voltage level to a period in which the voltage level of the segment signal is set to the third voltage level, and a common signal output circuit of the plurality of common signal output circuits setting a voltage level of a common signal to the second voltage level in the first transition period, and setting the voltage level of the common signal to the third voltage level in the second transition period.

12. An integrated circuit device comprising:

a segment driver having a plurality of segment signal output circuits for driving a plurality of segment lines;

a common driver having a plurality of common signal output circuits for driving a plurality of common lines;

a power supply circuit that supplies a plurality of power supply to the segment driver and the common driver;

a segment signal output circuit of the plurality of segment signal output circuits driving first voltage level of the plurality of power supply during a transition period which is a period between two consecutive driving period of a display;

a common signal output circuit of the plurality of common signal output circuits driving second voltage level of the plurality of power supply during the transition period; and the first voltage level being set with respect to the second voltage level so that OFF voltage level is applied to the display.

13. An electro optical device comprising the integrated circuit device recited in claim 12.

* * * * *